US010321707B2

(12) United States Patent
Klipfel et al.

(10) Patent No.: US 10,321,707 B2
(45) Date of Patent: Jun. 18, 2019

(54) METHOD FOR THE PRODUCTION OF HOMOGENIZED TOBACCO MATERIAL

(71) Applicant: PHILIP MORRIS PRODUCTS S.A., Neuchatel (CH)

(72) Inventors: Yorick Klipfel, St. Saphorin-sur-Morge (CH); Johannes Petrus Maria Pijnenburg, Neuchatel (CH); Michael Elliott Doyle, Ridgeway, VA (US); Juan David Manzur Bedoya, Lutry (CH); Pascal Rausis, Colombier (CH); Marine Jarriault, Bern (CH)

(73) Assignee: Philip Morris Products S.A., Neuchatel (CH)

( * ) Notice: Subject to any disclaimer, the term of this patent is extended or adjusted under 35 U.S.C. 154(b) by 50 days.

(21) Appl. No.: 15/503,519

(22) PCT Filed: Sep. 9, 2015

(86) PCT No.: PCT/EP2015/070654
§ 371 (c)(1),
(2) Date: Feb. 13, 2017

(87) PCT Pub. No.: WO2016/050470
PCT Pub. Date: Apr. 7, 2016

(65) Prior Publication Data

US 2017/0258126 A1 Sep. 14, 2017

(30) Foreign Application Priority Data

Sep. 30, 2014 (EP) ..... 14187202

(51) Int. Cl.
*A24B 15/14* (2006.01)
*A24B 3/14* (2006.01)

(52) U.S. Cl.
CPC ..... *A24B 15/14* (2013.01); *A24B 3/14* (2013.01)

(58) Field of Classification Search
None
See application file for complete search history.

(56) References Cited

U.S. PATENT DOCUMENTS 2,592,553 A 4/1952 Frankenburg
3,000,765 A * 9/1961 Rosenberg ..... A24B 15/14 131/352

(Continued)

FOREIGN PATENT DOCUMENTS

CN 88100385 8/1988
CN 1233428 11/1999

(Continued)

OTHER PUBLICATIONS

Office Action issued in China for Application No. 201580049815.1 dated Dec. 5, 2017 (23 pages). English translation included.

(Continued)

*Primary Examiner* — Dennis R Cordray
(74) *Attorney, Agent, or Firm* — Mueting, Raasch & Gebhardt, P.A.

(57) ABSTRACT

The present invention relates to a method of preparation of a slurry for the production of a homogenized tobacco material, said method comprising: —suspending a binder in an aerosol-former to form a suspension; —creating a cellulose pulp from cellulose fibers and water; —providing a tobacco powder blend; and —combining said suspension of binder in aerosol-former, said cellulose pulp and said tobacco powder blend to form said slurry.

17 Claims, 5 Drawing Sheets

(56) References Cited

U.S. PATENT DOCUMENTS

| | | | | |
|---|---|---|---|---|
| 3,053,259 | A | 9/1962 | Parmele | |
| 4,306,578 | A | 12/1981 | Schmidt | |
| 4,768,527 | A | 9/1988 | Graves, Jr. | |
| 5,584,306 | A * | 12/1996 | Beauman | A24B 3/14 131/355 |
| 8,061,361 | B2 * | 11/2011 | Maeder | A24F 47/006 131/270 |
| 2007/0215167 | A1 * | 9/2007 | Llewellyn Crooks | A24B 15/165 131/335 |
| 2016/0262443 | A1 * | 9/2016 | Piccirilli | A24B 15/16 |

FOREIGN PATENT DOCUMENTS

| | | |
|---|---|---|
| CN | 1403036 | 3/2003 |
| CN | 102160683 | 8/2011 |
| CN | 103110179 | 5/2013 |
| EP | 0565360 | 10/1993 |
| GB | 815315 | 6/1959 |
| GB | 961866 | 6/1964 |

OTHER PUBLICATIONS

PCT Search Report and Written Opinion for PCT/EP2015/070654 dated Nov. 3, 2015 (12 pages).

Leffingwell, J.C., 8A; "Basic chemical Constituents of Tobacco Leaf and Differences Among Tobacco Types", In: Davis, D.L., Nielson, M.T.: "Tobacco-Production, Chemistry and Technology", 1999, Blackwell Science Ltd., Oxford, GB, XP002741649, pp. 265-284, p. 268, p. 269.

* cited by examiner

METHOD FOR THE PRODUCTION OF HOMOGENIZED TOBACCO MATERIAL

This application is a U.S. National Stage Application of International Application No. PCT/EP2015/070654, filed Sep. 9, 2015, which was published in English on Apr. 7, 2016 as International Publication No. WO 2016/050470 A1. International Application No. PCT/EP2015/070654 claims priority to European Application No. 14187202.8 filed Sep. 30, 2014.

This invention relates to a process for producing homogenized tobacco material. In particular, the invention relates to a process for producing homogenized tobacco material for use in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material is reconstituted tobacco sheet and cast leaf. The process to form homogenized tobacco material sheets commonly comprises a step in which tobacco dust and a binder are mixed to form a slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. The function of the homogenized tobacco for use in conventional cigarettes is substantially limited to physical properties of tobacco, such as filling power, resistance to draw, tobacco rod firmness and burn characteristics. This homogenized tobacco is typically not designed to have taste impact. A process for making such homogenized tobacco is for example disclosed in European Patent EP 0565360.

In a "heat-not-burn" aerosol-generating article, an aerosol-forming substrate is heated to a relatively low temperature, in order to form an aerosol but prevent combustion of the tobacco material. Further, the tobacco present in the homogenized tobacco material is typically the only tobacco, or includes the majority of the tobacco, present in the homogenized tobacco material of such a "heat-not burn" aerosol-generating article. This means that the aerosol composition that is generated by such a "heat-not burn" aerosol-generating article is substantially only based on the homogenized tobacco material. Therefore it is important to have good control over the composition of the homogenized tobacco material, for the control for example, of the taste of the aerosol. The use of tobacco dust or leftovers from other tobacco productions for the production of homogenized tobacco material for aerosol-generating article is therefore less suitable because the exact composition of the tobacco dust is not known.

There is therefore a need for a new method of preparing a homogenized tobacco material for the use in a heated aerosol-generating article of the "heat-not-burn" type that is adapted to the different heating characteristics and aerosol forming needs of such a heated aerosol-generating article.

Further, there is a need for a homogenized tobacco material having a tensile strength adapted to withstand the forces acting on the homogenized material.

According to a first aspect, the invention relates to a method for the production of a homogenized tobacco material, the method comprising: creating a cellulose pulp from cellulose fibers and water, providing a tobacco powder blend; and combining the cellulose pulp, the tobacco powder blend, a binder and aerosol-former to form said slurry. According to the invention, the binder and the aerosol-former are pre-mixed in order to form a suspension and then combined with the cellulose pulp and tobacco powder blend.

Homogenized tobacco materials are formed by mixing several ingredients with water to obtain a slurry and then, for example by casting the slurry, creating a continuous web of homogenized material on a support. It is desired that the resulting of homogenized tobacco material has a relatively high tensile strength and a good homogeneity.

A reduced tensile strength may lead to difficulties in subsequent handling of the homogenized tobacco web in the production of the aerosol-generating article and could for example cause machine stops. Additionally, an inhomogeneous tobacco web may create unintended difference in the aerosol delivery between aerosol generating articles that are produced from the same homogenized tobacco web.

Further, another important parameter of the slurry which is used to realize the homogenized tobacco material is its viscosity, in particular at the time of casting or otherwise forming the continuous web of tobacco. Viscosity influences the tensile strength of the homogenized tobacco web and its uniformity. The density of the slurry, in particular before a step of casting the slurry to form a homogenized tobacco web, is important for determining the end quality of the web itself. A proper slurry density and homogeneity minimizes the number of defects and maximizes tensile strength of the web.

The slurry comprises a number of components to produce the homogenized tobacco web. These components influence the homogenized tobacco material properties. A first ingredient is a tobacco powder blend, which preferably contains the majority of the tobacco present in the slurry. The tobacco powder blend is the source of the majority of tobacco in the homogenized tobacco material and thus gives the flavor to the aerosol. A cellulose pulp containing cellulose fibers is added in order to increase the tensile strength of the tobacco material web, acting as a strengthening agent. A binder and an aerosol-former are added as well, in order to enhance the tensile properties of the homogenized sheet and promote the formation of aerosol. Further, in order to reach a certain viscosity and moisture optimal for casting a web of homogenized tobacco material, water is added to the slurry.

However, binders when in contact with water may gel and the gel cross-linking prevents a further uniform dispersion of the binder in the slurry, preventing to achieve the required slurry homogeneity and viscosity.

According to the invention, a pre-mixing between the binder and the aerosol-former is performed, so that the contact—and therefore the gel formation—between the water and the binder is delayed as much as possible. The suspension which is formed between the binder and the aerosol-former delays the formation of the gel when the suspension formed by the binder and the aerosol-former is combined with water. Without being bound by theory, the aerosol-former molecules delay the formation of the hydrogen bonds. In other words, the aerosol-former at least partially inhibits the cross linking of binder and water by positioning between the water and binder molecules.

The term "homogenized tobacco material" is used throughout the specification to encompass any tobacco material formed by the agglomeration of particles of tobacco material. Sheets or webs of homogenized tobacco are formed in the present invention by agglomerating particulate tobacco obtained by grinding or otherwise powdering of one or both of tobacco leaf lamina and tobacco leaf stems.

In addition, homogenized tobacco material may comprise a minor quantity of one or more of tobacco dust, tobacco fines, and other particulate tobacco by-products formed during the treating, handling and shipping of tobacco.

In the present invention, the slurry is formed by tobacco lamina and stem of different tobacco types, which are properly blended. With the term "tobacco type" one of the different varieties of tobacco is meant. With respect to the present invention, these different tobacco types are distinguished in three main groups of bright tobacco, dark tobacco and aromatic tobacco. The distinction between these three groups is based on the curing process the tobacco undergoes before it is further processed in a tobacco product.

Bright tobaccos are tobaccos with a generally large, light coloured leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio. From a sensorial perspective, bright tobacco is a tobacco type which, after curing, is associated with a spicy and lively sensation. According to the invention, bright tobaccos are tobaccos with a content of reducing sugars of between about 2.5 percent and about 20 percent of dry weight base of the leaf and a total ammonia content of less than about 0.12 percent of dry weight base of the leaf. Reducing sugars comprise for example glucose or fructose. Total ammonia comprises for example ammonia and ammonia salts.

Dark tobaccos are tobaccos with a generally large, dark coloured leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. According to the invention, dark tobaccos are tobaccos with a content of reducing sugars of less than about 5 percent of dry weight base of the leaf and a total ammonia content of up to about 0.5 percent of dry weight base of the leaf.

Aromatic tobaccos are tobaccos that often have small, light coloured leaves. Throughout the specification, the term "aromatic tobacco" is used for other tobaccos that have a high aromatic content, for example a high content of essential oils. From a sensorial perspective, aromatic tobacco is a tobacco type which, after curing, is associated with spicy and aromatic sensation. Example for aromatic tobaccos are Greek Oriental, Oriental Turkey, semi-oriental tobacco but also Fire Cured, US Burley, such as Perique, Rustica, US Burley or Meriland.

Additionally, a blend may comprise so called filler tobaccos. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cured Brazil lower stalk.

Within each type of tobaccos, the tobacco leaves are further graded for example with respect to origin, position in the plant, colour, surface texture, size and shape. These and other characteristics of the tobacco leaves are used to form a tobacco blend. A blend of tobacco is a mixture of tobaccos belonging to the same or different types such that the tobacco blend has an agglomerated specific characteristic. This characteristic can be for example a unique taste or a specific aerosol chemical composition, when heated or burnt. A blend comprises specific tobacco types and grades in a given proportion one with respect to the other.

According to the invention, different grades within the same tobacco type may be cross-blended to reduce the variability of each blend component. According to the invention, the different tobacco grades are selected in order to realize a desired blend having specific predetermined characteristics. For example, the blend may have a target value of the reducing sugars, total ammonia and total alkaloids per dry weight base of the homogenized tobacco material. Total alkaloids are for example nicotine and the minor alkaloids including nornicotine, anatabine, anabasine and myosmine.

The various tobacco types are in generally available in lamina and stems. In order to produce a slurry for a homogenized tobacco material, the selected tobacco types have to be ground in order to achieve a proper tobacco size, for example a tobacco size which is suitable for forming a slurry.

A cellulose pulp includes water and cellulose fibres. Tobacco itself includes naturally cellulose fibres. The cellulose fibres of the pulp are added to the slurry in addition to those cellulose fibres contained in the tobacco blend and are called in the following "added" cellulose fibres. Cellulose fibres for including in a slurry for homogenized tobacco material are known in the art and include, but are not limited to: soft-wood fibres, hard wood fibres, jute fibres, flax fibres, tobacco fibres and combination thereof. In addition to pulping, the added cellulose fibres might be subjected to suitable processes such as refining, mechanical pulping, chemical pulping, bleaching, sulphate pulping and combination thereof.

Fibres particles may include tobacco stem materials, stalks or other tobacco plant material. Preferably, cellulose-based fibres such as wood fibres comprise a low lignin content. Fibres particles may be selected based on the desire to produce a sufficient tensile strength. Alternatively fibres, such as vegetable fibres, may be used either with the above fibres or in the alternative, including hemp and bamboo.

The addition of a binder, such as any of the gums or pectins described herein, facilitates that the tobacco powder remains substantially dispersed throughout the homogenized tobacco web. For a descriptive review of gums, see Gums And Stabilizers For The Food Industry, IRL Press (G. O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

Slurry for the production homogenized tobacco material may comprise other ingredients or additives in addition to the above mentioned list. For example, the slurry may include, but not limited to, tobacco fibres, plasticisers, flavourants, fillers, aqueous and non-aqueous solvents, and combinations thereof.

According to the invention, the method for producing the slurry for the production of homogenized tobacco material includes a step of pre-mixing the aerosol-former and the binder, such as for example guar and glycerol, so that the two form a suspension, at least partially. A suspension is a heterogeneous mixture in which solute-like particles settle out of a solvent-like phase sometime after their introduction.

The suspension between aerosol-former and binder is performed in absence of water. In this context "the absence of water" is understood that the water content of the suspension of binder in aerosol-former is smaller than about 1 percent of the total weight of the suspension.

After the pre-mixing phase and suspension of binder in the aerosol-former, the slurry, according to the method of the invention, is formed.

The slurry is formed combining all the above mentioned elements together: the suspension of binder in aerosol-former, the pulp, and the tobacco powder blend. In the slurry formation, the binder enters in contact with water due to the fact that pulp contains water. When in contact with water, an aging process starts, where some gel may form and the viscosity of the slurry changes continuously. However, the binder in the suspension takes more time to form gel than without being pre-mixed in a suspension with the aerosol-former. Therefore, there is more time for mixing and rendering the slurry as uniform and homogeneous as possible before forming a homogenized tobacco web, for example by means of a casting step.

Preferably, the method of the invention further comprises the step of:

Adding water to the slurry formed by said suspension of binder in aerosol-former, said cellulose pulp and said tobacco powder blend.

Advantageously, said step of forming a pulp with cellulose fibers and water comprises:

Forming a concentrated pulp wherein the cellulose fibers in the concentrated pulp are in an amount between about 3 percent and about 5 percent of the total weight of the pulp.

The pulp is formed by adding together the cellulose fibres and water. The water is preferably added in two separate steps. First the pulp is produced mixing together the cellulose fibres and a first amount of water so that the amount of cellulose fibres in the total weight of the pulp is comprised between about 3 percent and about 5 percent. This concentrated pulp is then preferably stored and diluted when it is to be added to the other ingredients forming the slurry. In this way the amount of water to be introduced in the slurry can be easily controlled.

In an advantageous embodiment, the step of combining the suspension of binder in aerosol-former, the cellulose pulp and the tobacco powder blend to form the slurry comprises the step of:

Combining the suspension of binder in aerosol-former, the cellulose pulp and the tobacco powder blend in such a proportion that the binder is in an amount comprised between about 1 percent and about 5 percent in dry weight basis of the slurry.

In slurry for the preparation of homogenized tobacco material according to the prior art, the amount of binder added to it generally exceeds 5 percent in dry weight basis of the total amount of slurry. In the present method of the invention, only between about 1 percent and about 5 percent of binder in dry weight basis of the slurry is added to the slurry, reducing the total costs of the realization of the slurry, being the binder generally relatively expensive.

Advantageously, said step of combining the suspension of binder in aerosol-former, said cellulose pulp and said tobacco powder blend to form said slurry comprises:

Combining the suspension of binder in aerosol-former, the cellulose pulp and the tobacco powder blend in such a proportion that the aerosol-former is in an amount comprised between about 5 percent and about 30 percent in dry weight basis of the slurry.

The slurry of the invention contains a relatively large amount of aerosol-former, when compared to the slurry for the production of homogenized tobacco material according to the prior art. The relatively high amount of aerosol-former is used to make a suspension with the binder so that substantially all binder is surrounded by aerosol-former molecules, in order to keep the binder away from water as much as possible when combined in the slurry.

In a preferred embodiment, the method of the invention further comprises:

Combining the suspension of binder in aerosol-former, said cellulose pulp and said tobacco powder blend to form said slurry in a tank; and Cooling said tank in order to keep a temperature of said slurry between about 10 degrees Celsius and 40 degrees Celsius.

It has been observed that to obtain a slurry with a good tensile strength and relatively few defects, also the temperature of the slurry, which in turn is connected to the viscosity of the slurry, is a relevant parameter. Due to the fact that the slurry needs to be constantly mixed to render it homogeneous and uniform, the friction caused by the mixer may increase the temperature of the slurry. In order to keep the temperature under control within a suitable range between about 10 degrees Celsius and about 40 degrees Celsius, preferably between about 15 degrees Celsius and about 25 degrees Celsius, preferably the slurry tank is cooled. The tank preferably comprises a mantel which is cooled. The portions of slurry within the tank in contact with the mantel decrease their temperature by heat exchange. Due to the mixing in the slurry formation tank, the temperature becomes uniform as the portions of slurry in contact to the cooled mantel of the tank are moved towards the interior of the tank, where the temperature is higher. Mixing therefore allows a temperature homogenization of the slurry.

Advantageously, the method according to the invention further comprises:

Combining the suspension of binder in aerosol-former, the cellulose pulp and the tobacco powder blend to form said slurry in a tank; and Mixing the slurry.

Mixing allows homogeneously combining all ingredients of the slurry and creating a uniform mixture of all of them. When the water and the binder come into contact, the gelling of the binder with water may begin. This also means that, locally, the viscosity of the slurry will change continuously. Accordingly, to reach the viscosity target value at casting, preferably, the entire amount of slurry present in the tank has the same viscosity. This means that the entire slurry substantially has the same "age", that is, the amount of time spent in the tank and mixed.

More preferably, the slurry mixing is performed in a tank defining a central region and an outer mantel, the mixing being performed by means of a spiral mixer adapted to remove slurry from the outer mantel and to direct it towards the central region or to remove slurry from the central region and direct it towards the outer mantel, so as to uniformly mix the slurry.

As mentioned above, the slurry should be as homogeneous as possible so that also its viscosity is as uniform as possible and close to a target value optimal for casting. In order to obtain a uniform viscosity, the entire amount of slurry is preferably mixed. Accordingly, non-moving portions of slurry are minimized. Otherwise, these non-moving portions of slurry may attach to the side walls of the tank. For this purpose, the mixer is designed in such a way that the slurry is continuously moved from the external walls or mantel towards the center of the mixer or vice-versa. In this way, all the bulk of slurry continuously moves and there are no portions of slurry mixed more (or less) than others. This may greatly improve the homogeneity of the viscosity of the slurry and with that the physical properties of the cast tobacco web, including the machinability of the cast tobacco web.

In an embodiment, the step of forming a pulp with cellulose fibers and water comprises:

reducing the fiber length of the cellulose fibers by means of grinding in order to obtain an mean fiber length of said cellulose fibers comprised between about 0.2 millimeters and 4 millimeters.

According to the invention, cellulose fibres are introduced in the slurry, in addition to the cellulose fibres which are naturally present in the tobacco. The introduction of cellulose fibres to the fibres present in the tobacco in the slurry increases the tensile strength of the tobacco material web, acting as a strengthening agent. Therefore, adding cellulose fibres may increase the resilience of the homogenized tobacco material web. This supports a smooth manufacturing process and subsequent handling of the homogenized tobacco material during the manufacture of aerosol generating articles. In turn, this can lead to an increase in production efficiency, cost efficiency, reproducibility and production speed of the manufacture of the aerosol-generating articles and other smoking articles.

One relevant factor in the added cellulose fibres is the cellulose fibre length. Where the cellulose fibres are too short, the fibres would not contribute efficiently to the tensile strength of the resulting homogenized tobacco material. Where the cellulose fibres are too long, the cellulose fibres would impact the homogeneity in the slurry and in turn may create inhomogeneties and other defects in the homogenized tobacco material, in particular for thin homogenized tobacco material, for example with a homogenized tobacco material with a thickness of several hundreds of micrometers. According to the invention, the size of added cellulose fibres in a slurry comprising tobacco powder having a mean size between about 0.03 millimeters and about 0.12 millimeters and a quantity of binder between about 1 percent and about 3 percent in dry weight of the slurry, is advantageously between about 0.2 millimeters and about 4 millimeters, preferably between about 1 millimeters and about 3 millimeters. Further, according to the invention, the amount of the added cellulose fibres is comprised between about 1 percent and about 3 percent in dry weight of the total weight of the slurry. These values of the ingredients of the slurry have shown to improved tensile strength while maintaining a high level of homogeneity of the homogenized tobacco material compared to homogenized tobacco material that only relies on binder to address tensile strength of the homogeneous tobacco web. At the same time, added cellulose fibres having a mean length of between about 0.2 millimeters and about 4 millimeters do not significantly inhibit the release of substances from the fine ground tobacco powder when the homogenized tobacco material is used as an aerosol generating substrate of an aerosol generating article. In the present specification, the fibre "size" means the fibre length, that is, the fibre length is the dominant dimension of the fibre. Thus, mean fibre size has the meaning of mean fibre size length. The mean fibre length is the mean fiber length per a given number of fibers, excluding fibers having a length below about 200 microns or above about 10.000 microns and excluding fibres having a width below about 5 microns or above about 75 microns. According to the invention, a relatively fast and reliable manufacturing process of homogenized tobacco web can be obtained, as well as a substrate for a highly reproducible aerosol.

Advantageously, the step of forming a pulp with cellulose fibers and water comprises:

At least partially fibrillating the cellulose fibres.

The fibrillation of the added fibres in addition to those naturally present in the tobacco may improve the strengthening of the homogenized tobacco webs. To obtain fibres' fibrillation, the added fibres are for example subjected to mechanical friction shearing and compression forces. Fibrillation may include the partial delamination of the cell walls of the cellulose fibres, resulting in a microscopically hairy appearance of the wetted cellulose fibres' surfaces. The "hairs" are also called fibrillation. The smallest microfibrils may be as small as individual cellulose chains. Fibrillation tends to increase the relative bonded area between cellulose fibres after the slurry has been dried, increasing the tensile strength of the homogenized tobacco web.

Preferably, the step of mixing binder and aerosol-former to form a suspension comprises:

Adding a first amount of binder to a first amount of aerosol-former;

Mixing the first amount of binder and the first amount of aerosol-former; and

Adding a second amount of aerosol-former.

Binders are commonly relatively sticky substances that are prone to leave residues on the pipes on or supports in which are transported. The presence of a first pre-mixing step according to the method of the invention, in which binder and aerosol-former form a suspension, implies that a relatively large amount of binder is flowing in a process line to combine with the aerosol-former. The process line may thus often require cleaning, which causes an interruption of the production process of the homogenized tobacco material. The cleaning causes waste, requires time and reduced productivity. In order to minimize the cleaning intervention, some aerosol-former is used to "flush" the process line after the binder has been already transported. This way, advantageously, the process line may be efficiently cleaned during the production by removing fresh binder residues. Thus the step of adding a second amount of aerosol-former may comprise the step of flushing a process line with said second amount of aerosol-former so as to clean the process line.

Preferably, the method of the invention further comprises one or more of the following steps:

Monitoring a viscosity of the slurry;

Monitoring a temperature of the slurry; or

Monitoring a moisture of the slurry.

The formation of the slurry is a delicate process which determines the quality of the end product. Several parameters may be controlled to minimize the risk of a rejection of the homogenized tobacco sheet obtained with the slurry prepared according to the invention. For example, due to defects or a low tensile strength out of specification material could be formed. In particular, these process parameters are among other parameters, the temperature, the moisture, the residence time and the viscosity of the slurry. It is known that the viscosity is indeed a function of (among others) the temperature, the moisture and the residence time of the slurry. Therefore, preferably, at least one of the viscosity, the temperature and the moisture content of the slurry is monitored with appropriate sensors. Preferably, the sensor signals are used with a feedback loop for online signal processing and control to maintain the parameters within a set of predetermined ranges. For example, the process control may be influenced be appropriate changes to the such as the amount of cooling, the mixer temperature, the speed of the mixer, the amount of water introduced in the slurry, the amount of other compounds forming the slurry, combinations thereof and others.

Preferably, the method further comprises:

Casting the slurry; and

Drying the cast slurry.

A web of homogenized tobacco material is preferably formed by a casting process of the type generally comprising casting a slurry prepared including the blend of tobacco powder above described on a support surface. Preferably, the cast sheet is then dried to form a sheet of homogenized tobacco material and it is then removed from the support surface.

Preferably, the moisture of the cast tobacco material web at casting is between about 60 percent and about 80 percent in weight of the total weight of the cast tobacco web. Preferably, the method for production of a homogenized tobacco material comprises the step of drying said cast sheet, winding said cast sheet, wherein the moisture of said cast sheet at winding is between about 7 percent and about 15 percent of the total weight of the tobacco material web. Preferably, the moisture of said homogenized tobacco web at winding is between about 8 percent and about 12 percent of the total weight of the homogenized tobacco web.

The moisture of the slurry at casting is another important parameter to control which influences the homogeneity of the homogenized tobacco web.

According to a second aspect, the invention relates to a homogenized tobacco material comprising:

- a binder in an amount comprised between about 1 percent and 5 percent in dry weight basis of said homogenized tobacco material;
- an aerosol-former in an amount comprised between about 5 percent and about 30 percent in dry weight basis of said homogenized tobacco material;
- a grinded tobacco blend in an amount comprised between about 20 percent and about 93 percent in dry weight basis of said homogenized tobacco material; and
- cellulose fibres added to cellulose fibres present in the tobacco blend, the added cellulose fibres being in an amount comprised between about 1 percent and about 3 percent in dry weight basis of said homogenized tobacco material, said cellulose fibers comprising fibers from one or more of wood, flax, temp or tobacco.

The homogenized tobacco material may be cast leaf tobacco. The slurry used to form the cast leaf includes tobacco powder and preferably one or more of fibre particles, aerosol formers, flavours, and binders. Tobacco powder may be of the form of powder having a mean size on the order between about 0.03 millimeters and about 0.12 millimeters depending on the desired sheet thickness and casting gap. The amount of the tobacco blend is comprised between about 20 percent and about 93 percent, preferably about 50 percent and about 90 percent in dry weight basis of the homogenized tobacco material. Tobacco includes cellulose fibres. Further cellulose fibres in an amount comprised between about 1 percent and about 3 percent in dry weight basis of said homogenized tobacco material are added to the homogenized tobacco material in addition to the fibres naturally present in the tobacco itself. The added cellulose fibres could be also cellulose fibres deriving from other tobacco.

A third aspect of the invention is directed to an aerosol-generating article, comprising a portion of homogenized tobacco material that has been prepared according to the method as described above. An aerosol-generating article is an article comprising an aerosol-forming substrate that is capable of releasing volatile compounds that can form an aerosol. An aerosol-generating article may be a non-combustible aerosol-generating article or may be a combustible aerosol-generating article. Non-combustible aerosol-generating article releases volatile compounds without the combustion of the aerosol-forming substrate, for example by heating the aerosol-forming substrate, or by a chemical reaction, or by mechanical stimulus of an aerosol-forming substrate.

The aerosol-forming substrate is capable of releasing volatile compounds that can form an aerosol volatile compound and may be released by heating the aerosol-forming substrate. In order for the homogenized tobacco material to be used in an aerosol-forming generating article, aerosol formers are preferably included in the slurry that forms the cast leaf. The aerosol formers may be chosen based on one or more of predetermined characteristics. Functionally, the aerosol former provides a mechanism that allows the aerosol former to be volatilize and convey for example flavour in an aerosol when heated above the specific volatilization temperature of the aerosol former.

Specific embodiments will be further described, by way of example only, with reference to the accompanying drawings in which.

Figure 1:
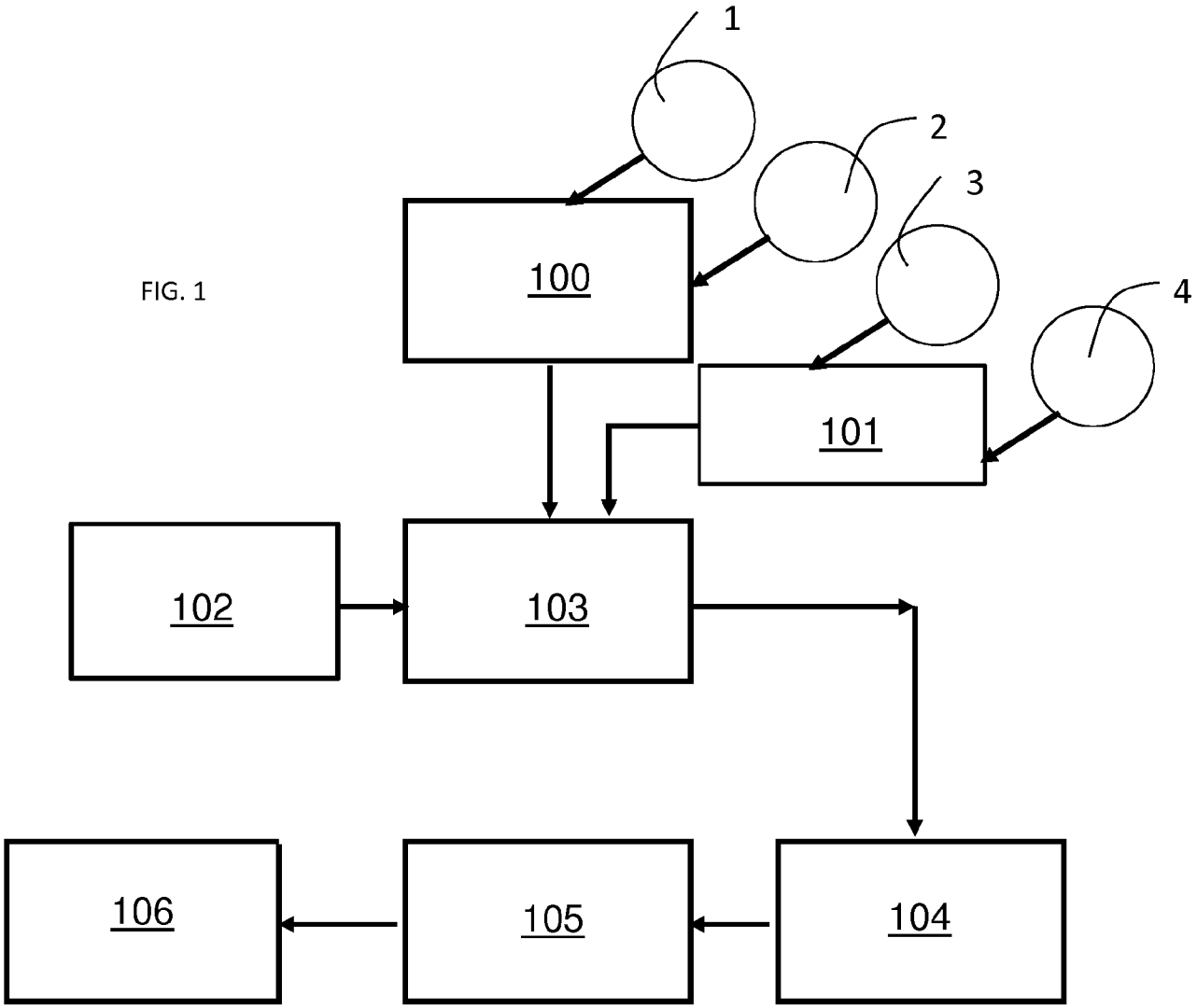
FIG. 1 is a flow diagram of an embodiment of the method of preparation of a slurry for the production of a homogenized tobacco material.

With reference to FIG. 1, a method to realize a slurry for the production of a homogenized tobacco material according to the invention is schematically depicted.

The method of realize the slurry includes a step of preparing a cellulose pulp 100. The pulp preparation step 100 preferably comprises mixing water 1 and cellulose fibers 2 in a concentrated form, optionally storing the pulp so obtained and then diluting the pulp before forming the slurry. The cellulose fibers, for example in boards or bags, are loaded in a pulper and then liquefied with water. The resulting water-cellulose solution may be stored at different densities, however preferably the pulp which is the result of the step 100 is "concentrate". Preferably, "concentrate" means that between about 3 and about 5 percent of cellulose fibers are included in the water/cellulose pulp. Preferred cellulose fibers are soft wood fibers. Preferably, the total amount of cellulose fibers in the slurry in dry weight, in addition to the cellulose fibres present in the tobacco blend added to the slurry, is between about 1 percent and about 3 percent, preferably, between about 1.2 percent and about 2.4 percent in dry weight of the homogenized tobacco material.

Preferably, the step of mixing of water and cellulose fibers lasts between about 20 and about 60 minutes, advantageously at a temperature comprised between about 15 degrees Celsius and about 40 degrees Celsius.

The storage time, if storage of the pulp is performed, may preferably vary between about 0.1 and about 7 days.

Advantageously, water dilution takes place after the step of storing of the concentrated pulp. Water is added to the concentrated pulp in such an amount that the cellulose fibers are less than about 1 percent of the total weight of the pulp. For example, a dilution of a factor comprised between about 3 and about 20 can take place. Further, an additional step of mixing may take place, which comprises mixing the concentrated pulp and the added water. The additional mixing step preferably lasts between about 120 minutes and about 180 minutes at a temperature between about 15 degrees Celsius and about 40 degrees Celsius, more preferably, at a temperature of between about 18 degrees Celsius and about 25 degrees Celsius.

Preferably, after the step of pulp preparation 100, an optional step of fibers' fibrillation is performed (not depicted in FIG. 1).

Figure 2:
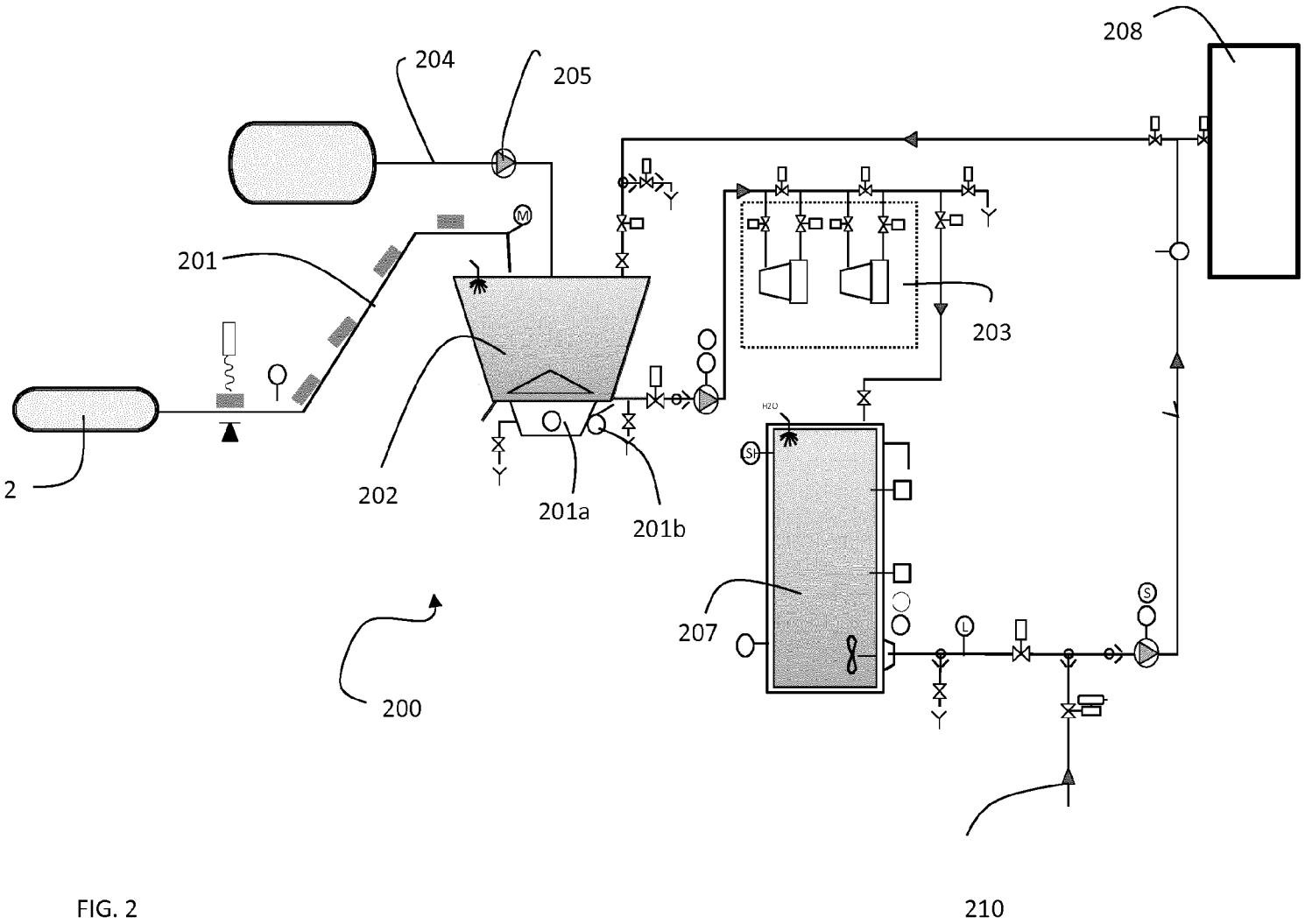
FIG. 2 is a schematic view of an apparatus for the production of a suspension of binder in aerosol-former.

An apparatus 200 to perform the method step 100 of the pulp formation is depicted in FIG. 2. FIG. 2 schematically depicts a cellulose fibre feeding and preparation line 200 comprising a feeding system 201, preferably adapted to handle cellulose fibres 2 in bulk form, such as board/sheets or fluffed fibers, and a pulper 202. The feeding system 201 is adapted to direct the cellulose fibres to the pulper 202, which is in turn adapted to disperse the received fibres uniformly.

The pulper 202 includes a temperature control unit 201*a* so that the temperature in the pulper is kept within a given temperature interval, and a rotational speed control unit 201*b*, so that the speed of an impeller (not shown) present in the pulper 202 is controlled and kept preferably comprised between about 5 rpm and about 35 rpm.

The cellulose fibre feeding and preparation line 200 further comprises a water line 204 adapted to introduce water in the pulper 202. A flow rate controller 205 to control the flow rate of water introduced in pulper 202 is preferably added in the water line 204.

The cellulose fibre feeding and preparation line 200 may also further comprise a fibre refiner system 203 to treat and fibrillate fibres, so that long fibres and nested fibres are removed, and a uniform fibre distribution is obtained.

Preferably, the mean fibre length of the cellulose fibres after the refining step is between about 0.2 millimeters and about 4 millimeters.

The mean size is considered to be the mean length. Each length of the fibre is calculated following the framework of the fibre, therefore it is the real developed length of the fibre. The mean fibre length is calculated per number of fibres, for example it may be calculated on 5.000 fibers.

Measured objects are considered as fibres if their length and width are comprised within:

200 μm<length<10.000 μm

5 μm<width<75 μm

In order to calculate the mean fibre length, the MorFi Compact fibre analyzer on fibers produced by Tech Pap SAS can be used.

The analysis is performed for example putting the fibres in a solution, so as to form an aqueous fibrous suspension. Preferably, deionized water is used and no mechanical mixing is applied during sample preparation. Mixing is performed by the fibre analyzer. Preferably, measurements are performed on fibres which have stayed at least 24 hours at about 22 degrees Celsius and about 50 percent relative humidity.

Downstream the fibre refiner system 203, the cellulose fibre feeding and preparation line 200 may comprise a cellulose buffer tank 207 connected to the fibre refiner system 203 to store the high consistency fibre solution coming out of the system 203.

At the end of cellulose fibre feeding and preparation line 200, a cellulose dilution tank 208 in which pulp is diluted is preferably present and connected to cellulose buffer tank 207. The cellulose dilution tank 208 is adapted to batch out cellulose fibres of right consistency for subsequent slurry mixing. Water for dilution is introduced in tank 208 via a second water line 210.

Referring back to FIG. 1, the method to realize the slurry according to the invention also includes a step of suspension preparation 101. The suspension preparation step 101 preferably comprises mixing an aerosol-former 3 and a binder 4 in order to form a suspension. Preferably, the aerosol-former 3 comprises glycerol and the binder 4 comprises guar. The suspension step 101 of binder in aerosol-former includes the steps of loading the aerosol-former and the binder in a container and mixing the two. Preferably, the resulting suspension is then stored before being introduced in the slurry. Preferably, the glycerol is added to the guar in two steps, a first amount of glycerol is mixed with guar and a second amount of glycerol is then injected in the transport pipes, so that glycerol is used to clean the processing line, avoiding hard-to-clean points within the line.

Figure 3:
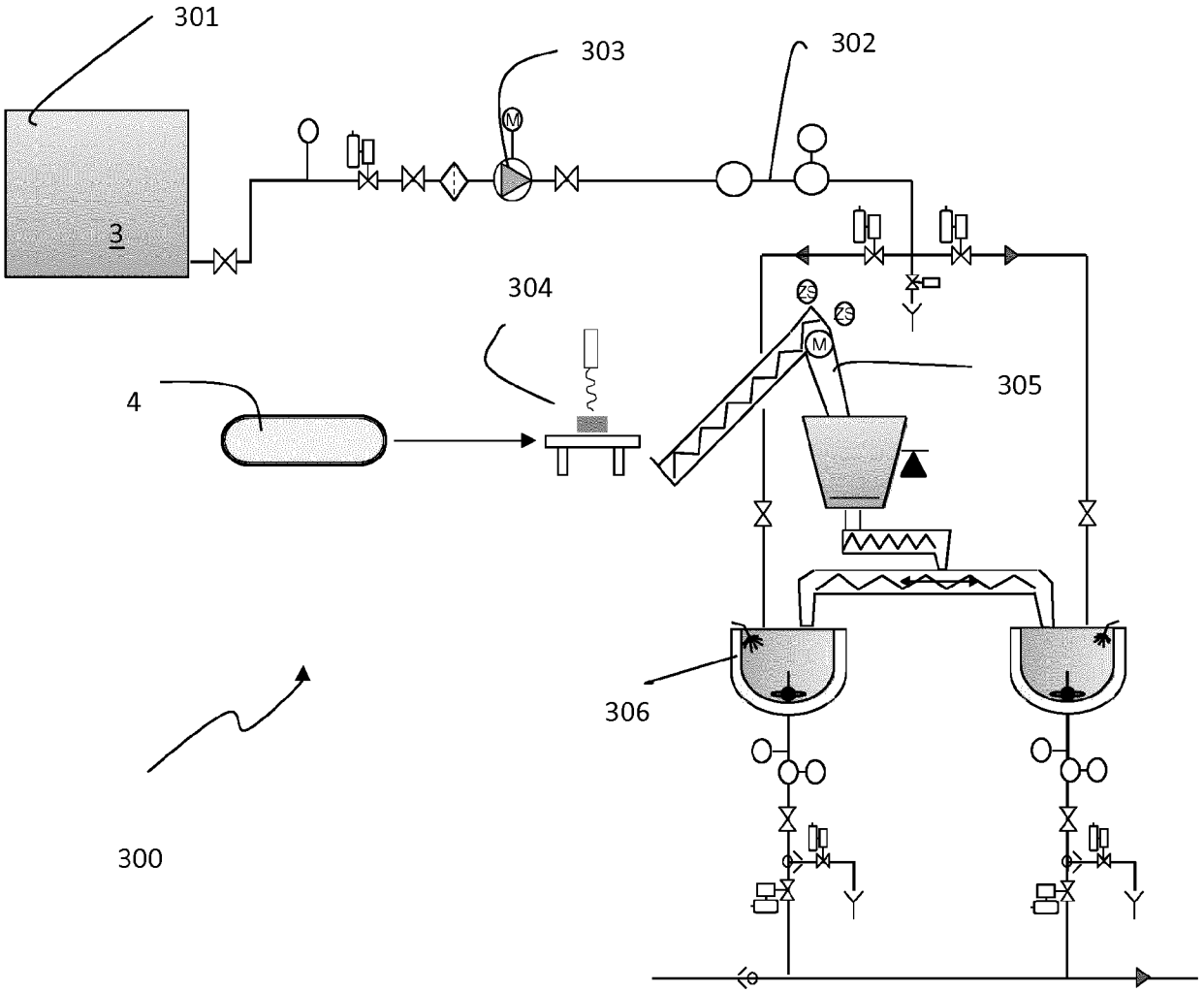
FIG. 3 is a schematic view of an apparatus for the production of cellulose pulp.

A slurry preparation line 300 adapted to perform the suspension step 101 of binder in aerosol-former of the invention is depicted in FIG. 3.

The slurry preparation line 300 includes an aerosol-former, such as glycerol, bulk tank 301 and a pipe transfer system 302 having a mass flow control system 303 adapted to transfer the aerosol-former 3 from the tank 301 and to control its flow rate. Further, the slurry preparation line 300 comprises a binder handling station 304 and a pneumatic transport and dosing system 305 to transport and weight the binder 4 received at the station 304.

Aerosol-former and binder from tank 301 and handling station 304 are transported to a mixing tank, or more than a mixing tank, 306, part of the slurry preparation line 300, designed to mix binder and aerosol-former uniformly.

All tanks and transfer pipes for cellulose fiber, guar and glycerol are preferably designed to be as optimally short as possible to reduce transfer time, minimize waste, avoid cross contamination and facilitate ease of cleaning. Further, preferably, the transfer pipes for cellulose fiber, guar and glycerol are as straight as possible, to allow a swift and uninterrupted flow. In particular for the suspension of binder in the aerosol-former, turns in the transfer pipe could otherwise result in areas of low flow rate or even standstill, which in turn can be areas where gelling can occur and with that potentially blockages within the transfer pipes. As mentioned before, those blockages can lead to the need for cleaning and standstill of the entire manufacturing process.

Further, the method of the invention includes a step of a tobacco powder blend formation 102. Tobacco has been blended and grinded in a blending and grinding line, not depicted in the drawing, in order to obtain a tobacco powder blend preferably to a mean size between about 0.03 millimeters and about 0.12 millimeters.

The method to form a slurry according to the invention further comprises a step of slurry formation 103, where the suspension 5 of the binder in the aerosol-former obtained in step 101, the pulp 6 obtained in step 100 and a tobacco powder 7 obtained in step 102 are combined together.

Preferably, the step of slurry formation 103 comprises first a step of introduction in a tank of the suspension of binder in aerosol-former 5 and of the cellulose pulp 6. Afterwards, the tobacco powder 7 is introduced as well. Preferably, the suspension 5, the pulp 6 and the tobacco powder 7 are suitably dosed in order to control the amount of each of them introduced in the tank. The slurry is prepared according to specific proportion among its ingredients. Preferably also water 8 is added.

Preferably, the step of slurry formation 103 further comprises a mixing step, where all the slurry ingredients are mixed together for a fixed amount of time. In a further step of the method according to the invention, the slurry is then transferred to a following casting step 104 and drying step 105.

Figure 4:
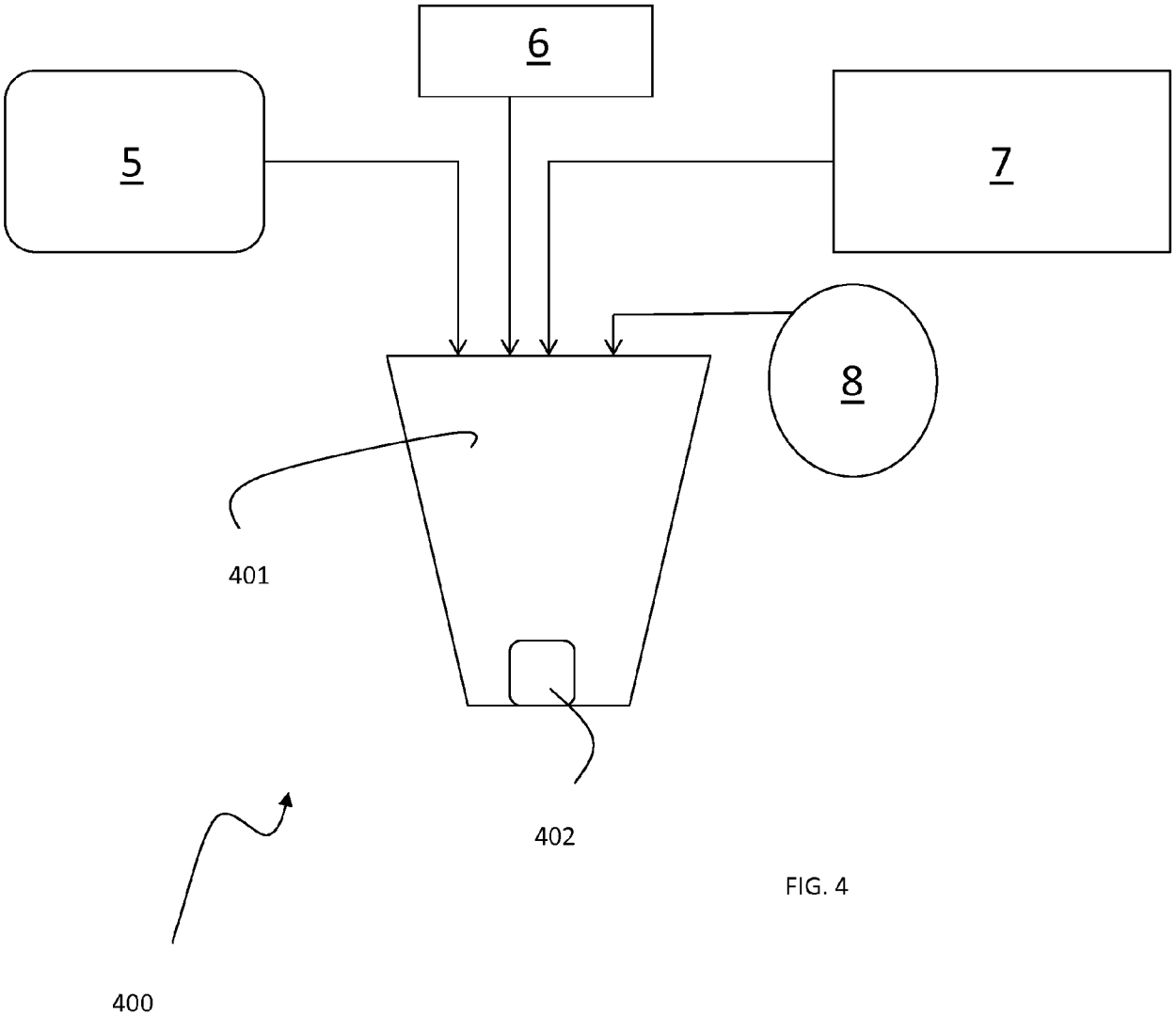
FIG. 4 is a schematic view of an apparatus for the preparation of slurry.

An apparatus 400 for the slurry formation adapted to realize step 103 of the method of the invention is schematically depicted in FIG. 4. Apparatus 400 includes a mixing tank 401 where cellulose pulp 6 and suspension 5 of binder in aerosol-former are introduced. Further, tobacco powder 7 from the blending and grinding line is fine-ground and dosed into the mixing tank 401 in specified quantity to prepare the slurry.

For example, the tobacco powder 7 may be contained in a tobacco fine powder buffer storage silo to ensure continuous upstream powder operation and meeting demand of slurry mixing process. Tobacco powder is transferred to the mixing tank 401 preferably by means of a pneumatic transfer system (not shown).

The apparatus 400 further comprises preferably a powder dosing system (also not shown) to dose required amount of the slurry's ingredients. For example, the tobacco powder may be weighed by a scale (not shown) or weighing belt (not shown) for precise dosing. The mixing tank 401 is specially designed to mix the dry and liquid ingredients to form a homogenous slurry. The slurry mixing tank preferably comprises a cooler (not shown), such as water jacket wall to allow water cooling on the external walls of the mixing tank 401. The slurry mixing tank 401 is further equipped with one or more sensors (not shown) such as level sensor, a temperature probe and sampling port for control and monitoring purpose. Mixing tank 401 has an impeller 402 adapted to ensure uniform mixing of the slurry, in particular adapted to transfer slurry form the external walls of the tank to the internal part of the tank or vice-versa. The speed of the impeller can be preferably controlled by means of a dedicated controlling unit. Mixing tank 401 also includes a water line for the introduction of water 8 at a controlled flow rate.

Preferably, mixing tank 401 includes two separated tanks, one downstream to the other in the flow of slurry, one tank for preparing the slurry and the second tank with slurry for transfer to provide continuous slurry supply to a slurry casting station.

The method of the invention to produce a homogenized tobacco web includes further a casting step 104 in which the slurry prepared in step 103 is cast in a continuous tobacco web onto a support. The casting step 104 includes transferring the slurry from the mixing tank 401 to a casting box. Then, the casting step 104 includes casting, preferably by means of a casting blade, the slurry onto a support, such as a steel conveyor. Further, in order to obtain a final homogenized tobacco web for the use in an aerosol-formed article, the method of the invention includes a drying step 105 in which the cast web of homogenized tobacco material is preferably dried. The drying step 105 includes drying the cast web, by means of steam and heated air. Preferably the drying with steam is performed on the side of the cast web in contact with the support, while the drying with heated air is performed on the free side of the cast web.

Figure 5:
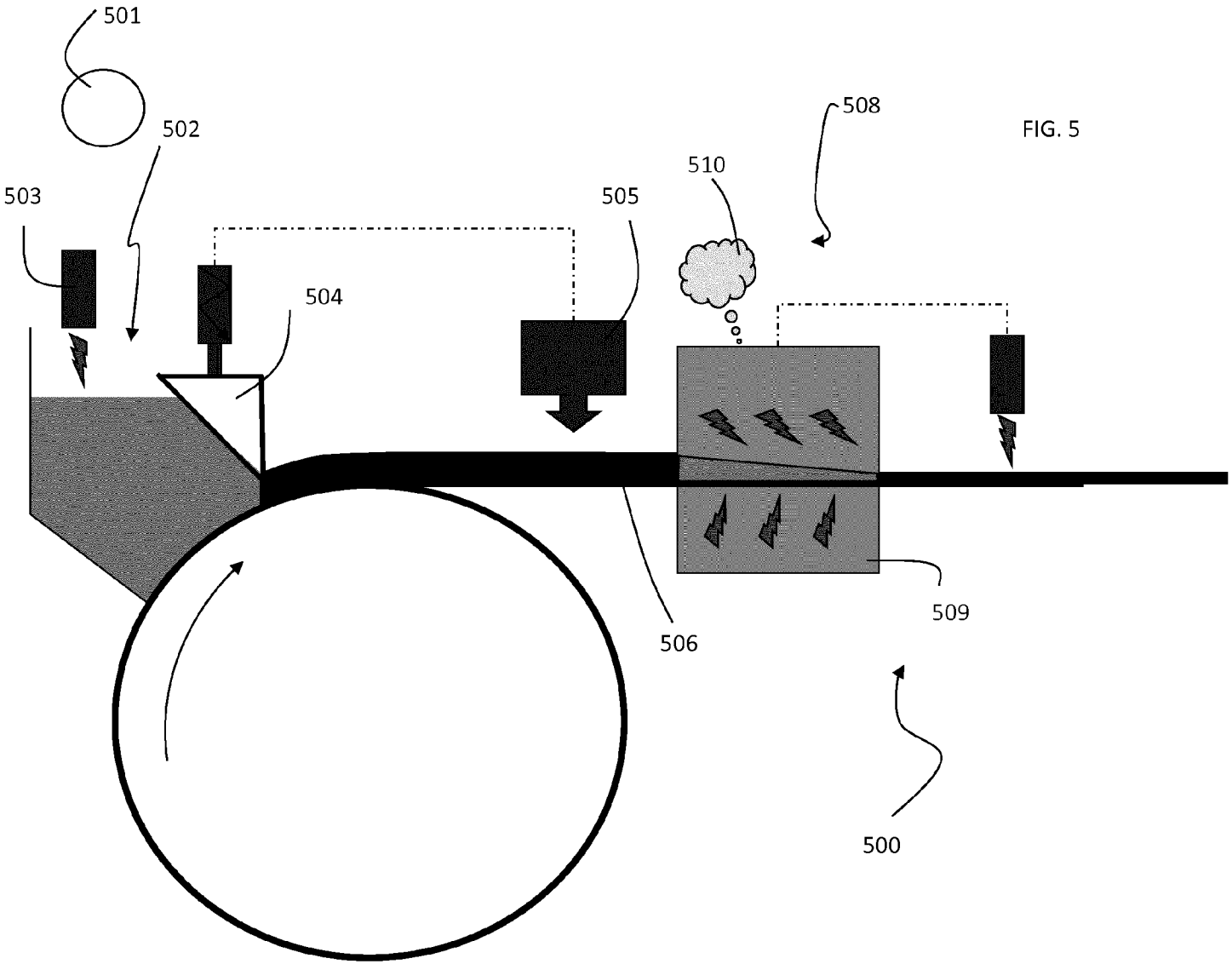
FIG. 5 is a schematic view of an apparatus for casting and drying a homogenized tobacco sheet.

An apparatus for performing the step of casting 104 and drying 105 is schematically depicted in FIG. 5. The casting and drying apparatus 500 includes a slurry transfer system 501, such as a pump, preferably having a flow control, and a casting box 502 to which the slurry is transferred by the pump. Preferably, casting box 502 is equipped with level control 503 and a casting blade 504 for the casting of the slurry into a continuous web of homogenized tobacco material. Casting box 502 may also comprise a density control device 505 to control the density of the cast web.

A support, such as a stainless steel belt conveyor 506, receives the slurry cast by the casting blade 504.

Casting and drying apparatus 500 also includes a drying station 508 to dry the cast web of slurry. Drying station 508 comprises a steam heating 509 and top air drying 510.

Preferably, at the end of the casting step 104 and of the drying step 105, the homogenized tobacco web is removed from the support 506. Doctoring of the cast web after the drying station 508 at the right moisture content is preferably performed.

Preferably, the cast tobacco web is transported through a secondary drying process to remove further moisture content of the web to reach target moisture.

After the drying step 105, the cast web is preferably wound in one or more bobbins in a winding step 106, for example to form a single master bobbin. This master bobbin may be then used to perform the production of smaller bobbins by slitting and small bobbin forming process. The smaller bobbin may then be used for the production of an aerosol-generating article (not shown).

The invention claimed is:

1. Method of production of a homogenized tobacco material, said method comprising:

suspending a binder in an aerosol-former to form a suspension;

creating a cellulose pulp from cellulose fibers and water;

providing a tobacco powder blend; and combining the suspension of binder in aerosol-former, the cellulose pulp and the tobacco powder blend to form a slurry.

2. Method according to claim 1, further comprising the step of:

Adding water to the slurry formed by the suspension of binder in aerosol-former, the cellulose pulp and the tobacco powder blend.

3. Method according to claim 1, wherein the step of forming a pulp with cellulose fibers and water comprises:

Forming a concentrated pulp wherein the cellulose fibers in the concentrated pulp are in an amount comprised between about 3 percent and 5 percent of the total weight of the pulp.

4. Method according to claim 1, wherein the step of combining the suspension of binder in aerosol-former, the cellulose pulp and the tobacco powder blend to form the slurry comprises the step of:

Combining the suspension of binder in an aerosol-former, the cellulose pulp and the tobacco powder blend in such a proportion that the binder is in an amount comprised between about 1 percent and about 5 percent in dry weight basis of the slurry.

5. Method according to claim 1, wherein the step of combining said suspension of binder in aerosol-former, the cellulose pulp and the tobacco powder blend to form the slurry comprises:

Combining the suspension of binder in aerosol-former, the cellulose pulp and the tobacco powder blend in such a proportion that the aerosol-former is in an amount comprised between about 5 percent and about 30 percent in dry weight basis of the slurry.

6. Method according to claim 1, further comprising:

Combining the suspension of binder in aerosol-former, the cellulose pulp and the tobacco powder blend to form the slurry in a tank; and Cooling the tank in order to keep a temperature of the slurry between about 15 degrees Celsius and about 40 degrees Celsius.

7. Method according to claim 1, further comprising:

Combining the suspension of binder in aerosol-former, the cellulose pulp and the tobacco powder blend to form the slurry in a tank; and Mixing the slurry.

8. Method according to claim 7, wherein the slurry mixing is performed in a tank defining a central region and an outer mantel, the mixing being performed by means of a spiral mixer adapted to remove slurry from the outer mantel and to direct it towards said central region or to remove slurry from the central region and to direct it towards the outer mantel, so as to uniformly mix the slurry.

9. Method according to claim 1, wherein the step of forming a pulp with cellulose fibers and water comprises:

reducing the fiber length of the cellulose fibers by means of grinding in order to obtain a mean fiber length of the cellulose fibers comprised between about 0.2 millimeters and about 4 millimeters.

10. Method according to claim 1, wherein the step of forming a pulp with cellulose fibers and water comprises:

At least partially fibrillating the cellulose fibers.

11. Method according to claim 1, wherein the step of mixing binder and aerosol-former to form a suspension comprises:

Adding a first amount of binder to a first amount of aerosol-former;

Mixing the first amount of binder and the first amount of aerosol-former; and

Adding a second amount of aerosol-former.

12. Method according to claim 1, further comprising one or more of the following steps:

Monitoring a viscosity of the slurry;

Monitoring a temperature of the slurry; or

Monitoring moisture of the slurry.

13. Method according to claim 1, comprising:

Casting the slurry so as to form a continuous homogenized tobacco web; and

Drying the homogenized tobacco web.

14. Method according to claim 13, wherein, before the casting step, the moisture of the slurry is comprised between about 60 percent and about 80 percent of the total weight of the slurry.

15. The method of claim 1, wherein suspending the binder in the aerosol-former is performed in the absence of water.

16. Homogenized tobacco material comprising:

a binder in an amount comprised between about 1 percent and 5 percent in dry weight basis of said homogenized tobacco material;

an aerosol-former in an amount comprised between about 5 percent and about 30 percent in dry weight basis of said homogenized tobacco material;

a grinded tobacco blend in an amount comprised between about 20 percent and about 93 percent in dry weight basis of said homogenized tobacco material; and cellulose fibres added to cellulose fibres present in the grinded tobacco blend, the added cellulose fibres being in an amount comprised between about 1 percent and about 3 percent in dry weight basis of said homogenized tobacco material, said cellulose fibers comprising fibers from one or more of wood, flax, hemp or tobacco.

17. Aerosol-generating device including a portion of said homogenized tobacco material according to claim 16.

* * * * *